US008001998B2

(12) United States Patent
Legrand et al.

(10) Patent No.: US 8,001,998 B2
(45) Date of Patent: Aug. 23, 2011

(54) SYSTEM FOR WEAVING A CONTINUOUS ANGLE

(75) Inventors: Xavier Legrand, Roubaix (FR); Georgi Tsarvarishki, Blagoevgrad-Bulgarie (BG); Julien Charles, Toulouse (FR); Philippe Blot, Nantes (FR)

(73) Assignee: Airbus Operations SAS, Toulouse (FR)

( * ) Notice: Subject to any disclaimer, the term of this patent is extended or adjusted under 35 U.S.C. 154(b) by 255 days.

(21) Appl. No.: 12/446,320

(22) PCT Filed: Oct. 25, 2007

(86) PCT No.: PCT/EP2007/061471

§ 371 (c)(1),
(2), (4) Date: Apr. 20, 2009

(87) PCT Pub. No.: WO2008/049883

PCT Pub. Date: May 2, 2008

(65) Prior Publication Data

US 2010/0319801 A1 Dec. 23, 2010

(30) Foreign Application Priority Data

Oct. 27, 2006 (FR) ..... 06 54583

(51) Int. Cl.

| | |
|---|---|
| ***D03D 13/00*** | (2006.01) |
| ***D03D 3/00*** | (2006.01) |
| ***D03D 47/27*** | (2006.01) |
| *D03D 41/00* | (2006.01) |

(52) U.S. Cl. ..... 139/11; 139/DIG. 1; 139/208; 139/305; 139/384 R; 139/189

(58) Field of Classification Search ..... 139/1 E, 139/11, 457, 16, 17, 17.5, 20, 24, 35, 55.1, 139/97, 208, 305, 189–192, 188 R, 449, 454, 139/383 R, 384 R, 386, 387 R, 388–390, 139/DIG. 1

See application file for complete search history.

(56) References Cited

U.S. PATENT DOCUMENTS

| | | | | | |
|---|---|---|---|---|---|
| 854,222 | A | | 5/1907 | Knapp | |
| 2,080,771 | A | * | 5/1937 | Hale | 139/16 |
| 2,414,663 | A | | 1/1947 | Parton | |
| 3,705,606 | A | * | 12/1972 | Stucki | 139/436 |
| 3,746,051 | A | * | 7/1973 | Mohelnicky et al. | 139/11 |
| 4,019,540 | A | * | 4/1977 | Holman et al. | 139/20 |
| 4,388,951 | A | * | 6/1983 | Atkinson et al. | 139/11 |
| 4,438,790 | A | * | 3/1984 | Steiner | 139/435.6 |
| 4,546,803 | A | * | 10/1985 | Dornier | 139/449 |
| 5,224,519 | A | * | 7/1993 | Farley | 139/11 |

(Continued)

FOREIGN PATENT DOCUMENTS

| | | |
|---|---|---|
| FR | 1 055 039 | 2/1954 |

(Continued)

*Primary Examiner* — Bobby H Muromoto, Jr.
(74) *Attorney, Agent, or Firm* — Oblon, Spivak, McClelland, Maier & Neustadt, L.L.P.

(57) ABSTRACT

A weaving loom including a mechanism drawing-in threads, for insertion of picks, and for formation of a weaving shed, so as to render possible formation of a continuous angle or corner by a thread during weaving. The loom preferably also includes a vertical offset system, so that it is possible to weave a three-dimensional surfacic structure, the threads of which are continuous between the faces and at the level of the edges. The loom can be configured particularly for manufacture of continuous tridedral corners that are used as reinforcements for composite structures.

15 Claims, 6 Drawing Sheets

U.S. PATENT DOCUMENTS

| | | | | |
|---|---|---|---|---|
| 5,261,464 | A * | 11/1993 | Lorenzo et al. | 139/93 |
| 5,351,722 | A * | 10/1994 | Mamiliano | 139/180 |
| 5,771,944 | A * | 6/1998 | Lin | 139/457 |
| 6,152,187 | A * | 11/2000 | Lindblom | 139/11 |
| 6,164,339 | A * | 12/2000 | Greenhalgh | 139/1 R |
| 6,315,007 | B1 * | 11/2001 | Mohamed et al. | 139/11 |
| 6,494,235 | B1 * | 12/2002 | Bruyere et al. | 139/11 |
| 6,913,045 | B2 * | 7/2005 | Fantino et al. | 139/11 |
| 2002/0153060 | A1 * | 10/2002 | Amalingan | 144/333 |
| 2004/0016084 | A1 * | 1/2004 | Yarboro | 19/215 |
| 2006/0249217 | A1 * | 11/2006 | Nayfeh et al. | 139/11 |
| 2009/0145508 | A1 * | 6/2009 | Speich et al. | 139/442 |
| 2011/0014403 | A1 * | 1/2011 | Wang et al. | 428/34.1 |

FOREIGN PATENT DOCUMENTS

| | | |
|---|---|---|
| GB | 2 277 730 A | 11/1994 |
| JP | 6-264325 | 9/1994 |

* cited by examiner

SYSTEM FOR WEAVING A CONTINUOUS ANGLE

TECHNICAL FIELD

The invention concerns the field of weaving, in particular of technical textiles in which at least one weft thread of the fabric forms a continuous angle, in relief for example.

More generally, the invention relates to a system that allows the drawing-in of several strips and the weaving in parallel of these strips, preferably using the same weft thread. The different elements of the loom are optimised so as to reduce its size, and to facilitate the different stages of weaving.

The system according to the invention is particularly designed for three-dimensional surfacic weaving used to create structures extracted from hexahedra, in particular from trihedral corners, woven continuously between the different edges.

PRIOR ART

Weaving has been employed since ancient times for making fabrics based on fibres organised in the form of threads. Despite mechanisation and automation of the process or of its use for textiles known as "technical", for example as reinforcements of composite materials, the current weaving process is based on the same bases as back then and, as such, has undergone minimal evolution.

In fact, all woven textiles comprise interlacing of threads divided into two categories: the "warp threads" are threads parallel to the selvedges of the fabric, and they are interlocked, according to a layout known as "weave", with a perpendicular series of "weft threads". The simplest weave consists of alternation in which each weft thread passes successively above and below a warp thread, with offset from one weft to the other ("plain weave").

To carry out weaving 1, such as illustrated in FIG. 1, the warp threads 2 are first rolled up on the same support, "the loom beam" 3, parallel to one another and over a width which will correspond to the width of the fabric 1; a "warp creel" is used to facilitate this operation in the case of fragile materials, but has considerable bulk. The weft thread 4 will be passed between the warp threads 2, each passage corresponding to a "pick". According to the type of pick vector, the web 2' of warp threads 2 can be prepared (for example by dressing) so as to increase its mechanical resistance, especially to friction.

The passage of each pick is facilitated by making a "weaving shed" 5 in the web 2', that is, by raising or lowering certain warp threads 2 relative to each other, such that an angular passing space 5 is created. To create the weaving shed 5, the warp threads 2 are returned to healds 6 which will undergo movement perpendicular to the web 2' coming from the loom beam 3. Different mechanisms (frame, Jacquard) create the weaving sheds according to the required weave.

The insertion of the pick 4 can be done using different processes. A conventional form of method involves the projection, across the strip, of a shuttle 7, a tool that holds a bobbin 8, with the latter containing a spooling of a certain length of weft thread 4. However, this passage generates friction. Although the application of size sometimes brings about an increase in mechanical strength, this solution cannot be adopted for all textiles and, in particular, not for the reinforcing threads of high-strength composite structures.

Other systems for passage of the pick have thus been developed. In particular, fluid jets (water or gas) can carry the thread to the other side of the strip. It is also possible to use a rapier, or even two rapiers each extending over half of the strip, where one rapier grasps the weft thread so as to send it to the middle of the strip and so to the other. However these solutions only allow the passage of a finite and short length of thread. It happens though, that in certain uses, continuity of the weft thread is important.

Finally, each time that a pick is passed through the weaving shed, a comb 9, in the teeth of which are held the warp threads 2, beats it down against the already formed fabric 1, during which the heddles 6 are operated to create another weaving shed 5 that again depends on the current weave.

It is clear that preparation of the strip of warp threads to be woven is lengthy. In particular, the insertion of the warp threads 2 into the heddles 6 has to be effected with precision, as does the positioning of the comb 9. These stages can also generate damage to the thread 2 due to rubbing, which is particularly problematic in the case of carbon fibres. Moreover, the presence of the heddles 6 and combs 9 implies a weaving device of considerable vertical dimensions, which is particularly unfavourable to technical textiles for example, where only a short and finite length of fabric 1 is achieved.

For example, in the aeronautical field, composite structures are developed to replace normally metallic elements of boxed structures (likewise known under the name "box"). However, for the junctions, "reinforcing corners" (or "corner fittings") are necessary, whereof the geometry seems simple: a classic corner fitting 10, illustrated in FIG. 2A, comprises for example three bidimensional walls 12, 14, 16, substantially flat, forming a corner cube angle (of "demi-cube" type).

So-called "three-dimensional" weaving methods have certainly been developed, in which the prosheath resulting from the weaving operation includes an interlacing of threads arranged in three directions in space. In particular, Aerotiss® methods are used to weave glass fibres and multi-layer interlaced carbon that can be used to create the leading edge skin of an aircraft, amongst other things. For parts of more complex shape, braiding can be used, which enables parts to be created directly in hollow shapes on an appropriate mandrel.

Like most of the three-dimensional shapes with two-dimensional walls however, a strengthened box-corner textile preform can be created on the existing machines only from a "flattened" version of the walls and by means of a sewing 10*z* between at least two faces 14, 16.

Now, a sewing is an element apart, fragile to a degree, which gives rise to problems of mechanical strength that are incompatible with aeronautics. Moreover, since continuity of the fibres along the different planes is not guaranteed, the strengthening function is not fully achieved. As a result, the box corners, even with boxed composite structures, are manufactured from a metal medium.

Furthermore, complex stresses can suggest thread continuity in other woven parts, including a thread forming an angle within the fabric, that is a thread that is parallel to one edge of the piece over a certain length, and parallel to another edge over a consecutive length. This continuity can be fundamental for the composite reinforcing of technical textiles, and in particular in aeronautics.

It thus appears that the weaving looms can be improved, in particular regarding their use for the creation of technical textiles.

PRESENTATION OF THE INVENTION

The invention proposes a device that is designed to create structures that have a multiplicity of faces that are orthogonal to each other and connected along at least three edges continuously, such as trihedral corners without sewing, for example.

More generally, the invention relates to a weaving loom used for insertion of thread to form an angle within the piece to be woven.

The loom of the invention thus includes first and second means used to insert threads to form two strips that cross each other, first and second means to form weaving sheds in the two strips, first and second means to beat the picks into the two strips, using combs that are attached to each other for example.

Since the formation of one of the strips is effected during the weaving of the other, one of the two means of drawing-in at least, and preferably both, is open, and composed of hooks. One of the two weaving-shed formation systems, and preferably both, is also open, meaning that it includes open thread-manipulation elements. In order to reduce the size, the offset of the threads to form the weaving shed is advantageously effected by means of a rod attached to the manipulation elements, preferably the drawing-in hooks, which pivots about an axis and allows movement of the threads when a pressure is exerted upon it. A system switching between two contact positions on the rod advantageously allows the formation of the weaving shed, namely a rest position in which an initialisation axle presses on all of the rods in order to align them, and an operating position in which selected thrust elements press in the other direction on certain rods so as to offset certain hooks in relation to the others. Switching is preferably effected about the same pivoting axis as the rods.

In addition, the pick is inserted continuously between the two strips, and the loom of the invention includes a spool that is able to contain a winding of weft thread of sufficient length. The loom is equipped with means that are used to receive the spool during its insertion at the corner between the two strips, preferably a receptacle equipped with temporary holding means that can also include means for guiding the spool in order to ensure insertion without friction.

The pick is advantageously inserted in a manner that is directed by temporary attachment of the spool to insertion rapiers that determine a weaving direction in each strip. The holding receptacle of the spool is then advantageously mounted so that it turns to orient its opening in the direction of each rapier employed.

In order to effect three-dimensional surfacic weaving, the loom can be equipped with means allowing the offsetting of a woven surface in relation to the strips, such as a mobile frame for example, in a direction perpendicular to the loom structure.

In order to compensate for the different tractions and in particular to allow the weaving of non-stretchable carbon-type threads, the drawing-in hooks are advantageously associated with tensioning means, of the spring type, working individually and/or collectively.

It is possible to arrange to weave a third side of a strip, that is a second (or even third) corner, by providing a spool-receiving sheath, accompanied where appropriate by an insertion rapier. Drawing-in hooks on one or two other sides of the loom structure can also be provided.

SHORT DESCRIPTION OF THE DRAWINGS

Other characteristics and advantages of the invention will emerge more clearly on reading the description that follows and with reference to the appended drawings, which are provided for illustrative purposes only and are in no way limiting.

FIG. 1, described previously, schematically illustrates a conventional weaving method.

FIG. 2 schematically represents a woven fold to form a box corner.

DETAILED PRESENTATION OF PARTICULAR EMBODIMENTS

According to the invention, it is possible to manufacture a woven fold 10 in three dimensions with continuity of threads between each adjacent face 12, 14, 16 of the fold. In particular, this allows the formation of one or more corners with no process other than the weaving. More generally, even for a "flat" weave, the weaving loom of the invention allows the insertion into the weft of a thread that makes an angle between two parts of the thread respectively parallel to the two edges of the fabric.

To this end, a weft thread inserted into a weave strip must be capable of being inserted in two directions, and therefore two weave strips must be capable of being formed at the same time.

Figure 3:
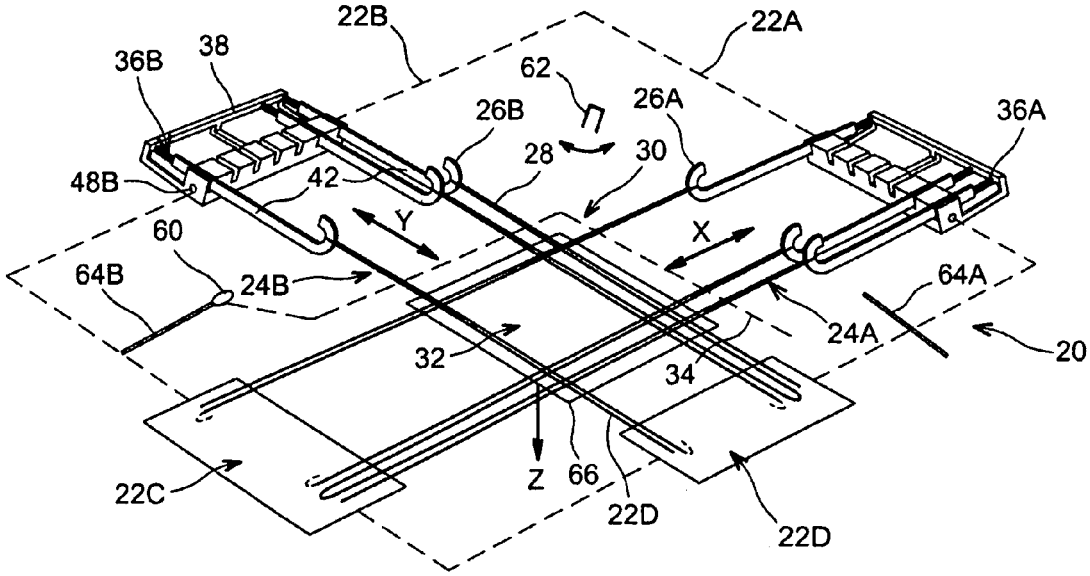
FIG. 3 represents a weaving loom according to one embodiment of the invention.

The weaving loom 20 according to the invention therefore includes, on two adjacent sides of its structure 22, preferably orthogonal to each other, two means of drawing-in the thread, with at least one of the two being open so as to form the corresponding strip at the same time as the weave (see FIG. 3).

As a consequence, the first strip 24A can, as one would expect, be stretched between the opposing first side 22A and third side 22C of the structure, to be woven by a weft thread. On a second side 22B, the loom structure includes hooks 26B used to pass a thread around in order to form a secondary strip 24B. During the weaving of the primary strip 24A, the primary weft threads 28 are extended so as to pass around the hooks 26B, and thus form a second strip 24B that forms a closed angle 30, of 90° for example if the weave is orthogonal, with the first strip 24A at the level of the woven piece 32. It will be possible to weave this angle 30 continuously with a single weft thread. In particular, when the first face 32 has been woven, the secondary weft thread 34, instead of being attached to a hook, can be used to weave the secondary strip formed 24B, with the initial weft threads 28 then working as warp threads.

The primary strip 24A is advantageously put in place by means of the same system of strip formation with hooks 26A. The opening of this system also allows continuity of the warp threads forming the strip 24A, which is particularly advantageous in the case of weaving fibres used to reinforce composite structures, such as carbon or aramid fibre for example.

The hooks 26A, 26B are preferably associated individually with a loop tensioning system 36A, 36B used to work threads 28 that are not very stretchable. A regulation system 38 for collective tensioning of the threads can also ensure the tension of the fabric 32. The "reserve of threads" function of the beam or of the creel is replaced by a tension regulation device for the collective threads 38 which has an X,Y backward offset that is sufficient for the dimensions of the final preform.

Thus, according to the invention, the initial drawing-in warp threads is effected, manually for example, in a first series of open frames 22A, including attachment hooks 26A, where appropriate, on each side 22A, 22C. The weaving of this strip 24A allows the formation of the first face 32. Similar to conventional two-dimensional weaving, the method includes the insertion of weft thread 28 into the first series of threads 24A put in place on the loom 20, which work in warp (primary warp threads). To this end, the loom 20 includes a first weaving-shed formation system, which can be conventional or, preferably, will be identical to that of the second strip and described later.

Parallel to the weaving of the first face 32, which is effected according to a customary technique and with a plain weave for example, a second strip 24B is formed. In the case where the weave of the first face 32 is orthogonal, this second strip 24B is, in particular, perpendicular to the first face 32. To this end, the weft threads 28 used for the first face 32 traverse the strip 24A and make a loop at the level of their respective hooks 26B, and then again traverse the frames in the other direction. Depending on the shapes wanted, it is possible to tighten these primary weft threads on the structure 22 at a fourth side 22D opposite to the second side 22B, and advantageously itself also fitted with open drawing-in hooks providing continuity of the thread (thus forming a fourth strip 24D), or to take up the weaving directly in the other direction at the opposite edge of the woven piece 32.

Thus, a plane fabric 32 is obtained by virtue of the system of open frames, jointly with drawing-in in a second system of frames 22B with the threads used in weft (or picks) 28, meaning that a face 32 is woven while doing the drawing-in weft threads 28 which will be used in warp in a following phase to insert secondary weft threads 34.

Since the secondary strip 24B is intended to be woven, a weaving shed must be capable of being opened between the threads 28. The loom of the invention includes a second weaving-shed formation system 40 traversing the strip 24B, parallel to the second edge 22B of the structure for example. The weaving shed formation system 40 is preferably totally open in order to simplify the formation of the strip 24B. It can also be peddles in two separable parts, the first part being open during the drawing-in of the strip and being closed by the second part when the strip forms, in order to carry on as usual.

The opening of the weaving shed preferably occurs without any frame or Jacquard mechanism, for a size less than that imposed by this type of system. The selection of the threads 28, and therefore their vertical movement, occurs by virtue of a tilt system, preferably acting directly on the hooks 26B. The weaving-shed formation system of the primary strip 24A also advantageously functions by tilting, acting directly on the drawing-in hooks 26A. This is particularly suitable for a small size such as is found in weaving units associated with a tilt system for the prosheathion of composite structures.

Figure 4:
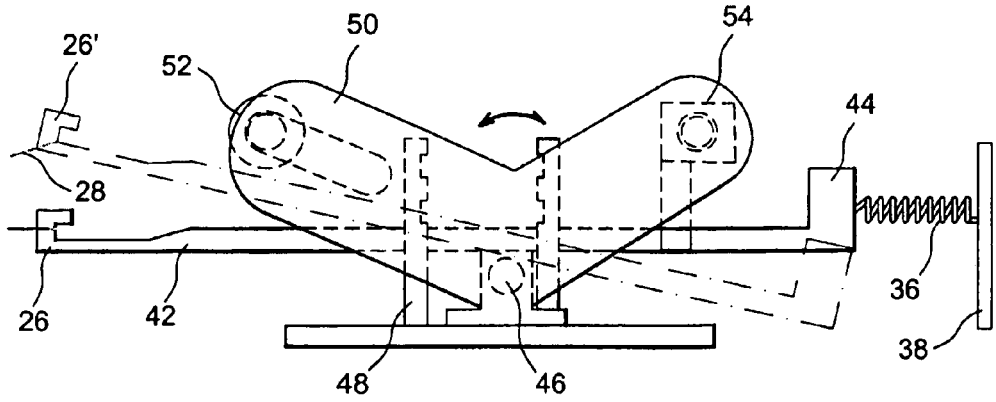
FIG. 4 shows a weaving-shed formation system preferably used in a loom according to the invention.

To this end, as illustrated in FIG. 4, the hooks 26 are each attached to one end of an operating rod 42, and the other end 44 of the rod 42 is coupled to the tensioning system 36, 38, for example.

Between the two ends 26, 44 of the rod is located an axle 46 that allows pivoting of the operating rod 42 by a thrust exerted on one part of the latter, in order to raise or lower the hook 26. The rods 42 are advantageously guided by means of a ramp 48, which can form the edge 22 of the loom structure 20.

In order to tilt the hook 26 upward or downward, a tilt system 50 preferably presses onto one or the other part of the rod 42. Thus, the tilt system 50 includes an initialisation axle 52 that operates all the rods 42 together in order to align them, thus creating an initial position of the hooks 26, preferably in a down position that corresponds to the plane of the strip 24 of warp threads.

The tilt system 50 also includes a device 54, which selects the hooks 26' that must rise according to the weave to be created, and then raises them to form the weaving shed 56 by pressing on the other part of the corresponding operating rod 42. The selector device 54 can thus include thrust elements 58 that are able to assume two positions, according to their method of operation, retractable for example. During the formation of the weaving shed 56, the selector device 54 activates the elements 58, and as a consequence, the latter exert a pressure on their rod 42, to raise the hooks 26'. The selection is then modified according to the weave to be created, by mechanical or electronic selection of the thrust elements 58.

The initialisation axle 52 and the thrust elements 58 are linked by means such as operation of the activated thrust elements 58, which leads to a withdrawal of the initialisation axle 52. In particular, this coupling itself also functions by tilting, and includes an oscillating lever 50 pivoting about the same axle 46 as the manipulating rods 42.

The kinematics are thus composed of two principal movements, namely a positive rotation around the tilting axle 46 of the weaving-shed formation systems in order to open the weaving shed 56, and a negative rotation around axle 46, closing the weaving shed.

a) The selection system 54 of the hooks 26 is in the up position, the descent axle 52 is in the down position. The hooks 26 are therefore in the initial position (the down position).

b) A positive rotation of the oscillating lever 50 allows the selection system 54, 58 to select the hooks 26' and to raise them. The hooks 26' then pivot, pressing on the ramp 48 in the up position. The weaving shed 56 is thus opened, and a weft thread can then be inserted and woven.

c) The weaving shed 56 can now re-close. To this end, the descent axle 52 driven by the barapier arm 50 in its negative rotation lowers the raised hooks 26'. Therefore, all the hooks 26 are now in their initial position (the down position), and the weaving shed is closed.

Certainly, according to this illustrated embodiment, the weaving sheds 56 are formed by an even number of warp threads 28, but this presents no problem for the technical textiles, and in particular the reinforcements for composite structures. The system 40 would however be adaptable for an odd weave, for example by making a loop about two consecutive hooks 26 during the drawing-in. It would also be possible to couple the operating rods 42 to other manipulation elements of the threads, for example a series of hooks placed about each thread 28 within strip 24.

By virtue of the weaving loom 20 according to the invention, when the first face 32 has been woven, then weaving occurs simultaneously on the two strips created 24A, 24B (primary warp threads and secondary warp threads), with a non-rectilinear insertion of the weft thread 34.

In order to ensure the continuity of the secondary weft thread 34 during the formation of the corner 30, the pick must include a sufficient length of thread. Conventionally, the weft thread 34 is in the form of a winding about a spool 60. Means are provided on the loom 20 in order to allow a temporary placement of the spool 60 of weft thread 34 between the two strips 24A, 24B, in order to be able to selectively operate the means of insertion in the first 24A or the second strip 24B. In particular, the placement means 62 include a cylindrical receptacle designed for the size of the spool 60, that is a sheath 62 in which the spool 60 can be placed in a temporary manner. The sheath 62 is advantageously equipped with suitable retention means, such as a clamp coupled to a stitch for example. The sheath 62 can also be equipped with guidance means used to avoid friction or impact between the spool 60 and the walls of the sheath 62 during insertion. For example, the spool 60 is equipped with a pointed appendage (unitary or added) at the end entering into the sheath 62, which itself is equipped with an orifice of complementary shape, opening through or not, used for progressive readjustment of the position of the spool 60 by the guidance of the appendage into the orifice.

The sheath 62 is placed in the structure 22, between the first and second sides 22A, 22B and the strips 24A, 24B. Since the pick 34 is inserted in a predetermined direction in each strip 24, the sheath 62 is advantageously mounted in a rotary manner, and its opening can face in both directions of insertion of the pick 34.

The insertion of the pick 34 is preferably effected by means of a directional rapier 64 in each strip 24. Each rapier 64 then includes the means allowing it to couple in a temporary manner to the spool 60, and to place it in the sheath 62 when it reaches it, thus allowing the transfer of the spool 60 from one rapier to the other (multiple pick insertion system). Thus, continuity of the threads can be guaranteed, while also avoiding damage to the threads constituting the weaving shed. For the weaving, the first rapier 64A carrying the spool 60 is inserted into the open weaving shed, orthogonally to the strip 24A for example. Once arrived at the end of the strip of warp threads 24A, the rapier 64A then deposits the spool 60 in the sheath 62, and then comes out of the weaving shed empty, to return to the initial position. The weaving shed formation system then re-closes, and where appropriate a tamping comb is used, forming the fabric. The sheath 62 turns toward the second direction, perpendicular to the other strip 24B, and an empty rapier 64B comes to fetch the spool 60 to pass through the second weaving shed.

This transfer is used to direct the thread and therefore the weave along a certain angle. Of course, depending on the number of strips 24 to be woven on the loom, it is possible to form several such corners 30. There are then as many sheaths 62 as there are angles 30 to be created. This technique is used to ensure continuity of the threads while also ensuring a high directivity of the weave, and minimising friction between the threads.

Parallel to the weaving of the corner 30, it is advantageous to proceed to an offset of the woven face 32 in a direction that includes a component Z normal to the X,Y plane of the strips. For example, a lowering of the woven surface 32 in relation to the strips 24A, 24B allows the pick 34 to be placed so as to form an angle 30 above this surface 32, and to form a three-dimensional piece that includes a first wall 32 and two preforms of walls, making a corner. The device is then used to weave a fold of trihedral angular form directly according to the desired three-dimensional profile, in accordance with FIG. 2 for example, with continuity of the threads between the faces 12, 14, 16 and at the edges 10z.

To this end, the loom 20 then includes the means 66 to effect this offset. In particular, the weaving is effected on threads stretched into a structure 22, which remains fixed, but that includes a mobile shaping frame 66 that offsets the woven preform by pressing onto the first face 32 in order to ensure the formation of the corner 30, the tensioning of the fabric, and the "marking" of the edges. The mobile frame 66 preferably corresponds to the surface of the first woven face 32, but it could be limited to a zone adjacent to the edges of this face, or even only to the edges along which the secondary weft threads 34 pass. The frame 66 causes the fabric to be raised simultaneously with the advance of the weaving in the Z direction, in order to achieve optimal placement of the threads 34 working in direction Z during the weaving.

As illustrated in FIG. 5, the weave, using a loom of the invention, is preferably created in the following manner:

1. In a first stage, as presented above and illustrated in FIG. 3, there is the formation of the first strip 24A, weaving of the first face 32 parallel to the drawing-in of the second strip 24B. The pick 28 can be inserted by the first rapier system 64A or manually. The pick 28 can be continuous with the warp threads or not.

Figure 5A:
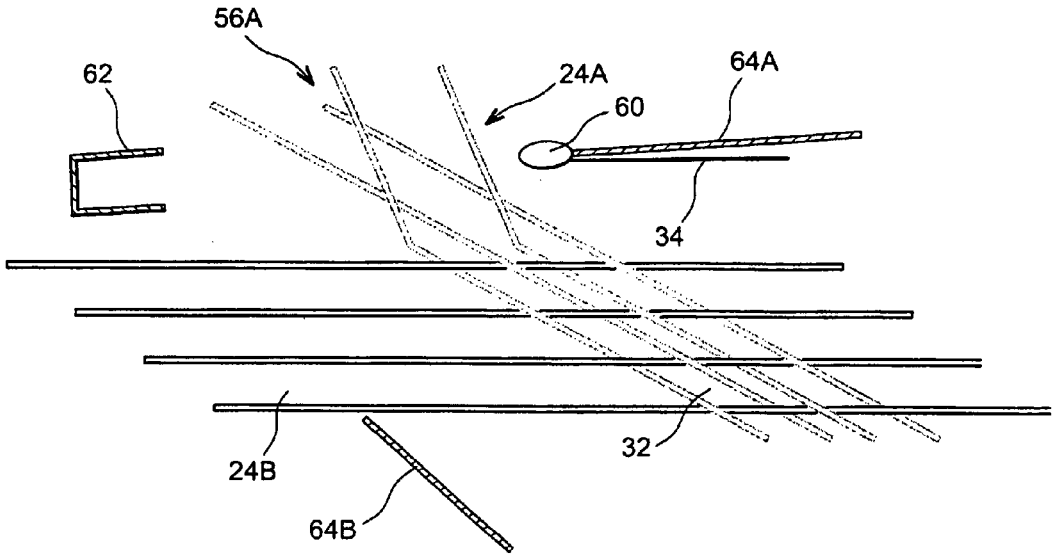
FIGS. 5A to 5H illustrate a method of three-dimensional surfacic weaving with a loom according to the invention.

2. The weaving shed 56A of the first strip 24A opens (FIG. 5A).

Figure 5B:
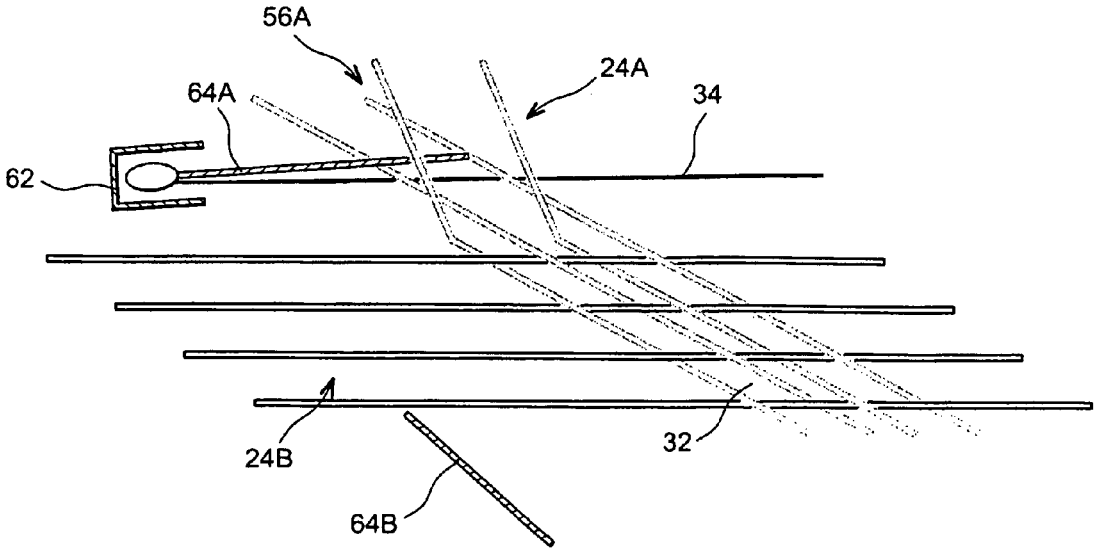

3. The first rapier 64A, holding at its end the spool 60 of secondary weft thread 34, is inserted into the weaving shed 56A. It is possible that the secondary weft thread 34 may be unitary with the primary weft thread 28. Once the weaving shed has been traversed, the rapier 64A inserts the spool 60 into the first sheath 62 and releases it after the sheath 62 has clamped the spool 60 (FIG. 5B).

Figure 5C:
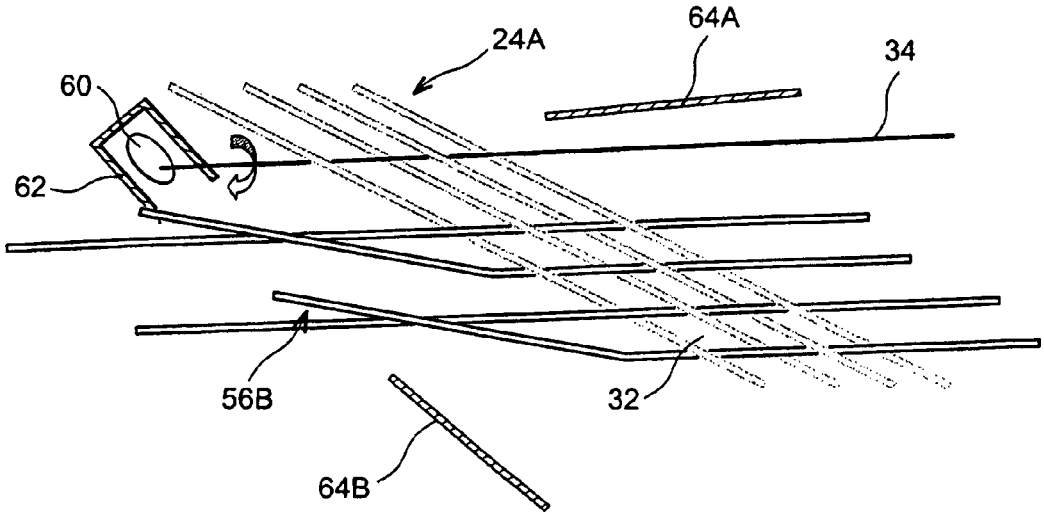

4. The first rapier 64A comes out of the weaving shed 56A, which closes. During this time, the sheath 62 does a rotation in the direction of the second rapier 64B, and the second series of frames open a weaving shed 56B in the second strip 24B (FIG. 5C).

Figure 5D:
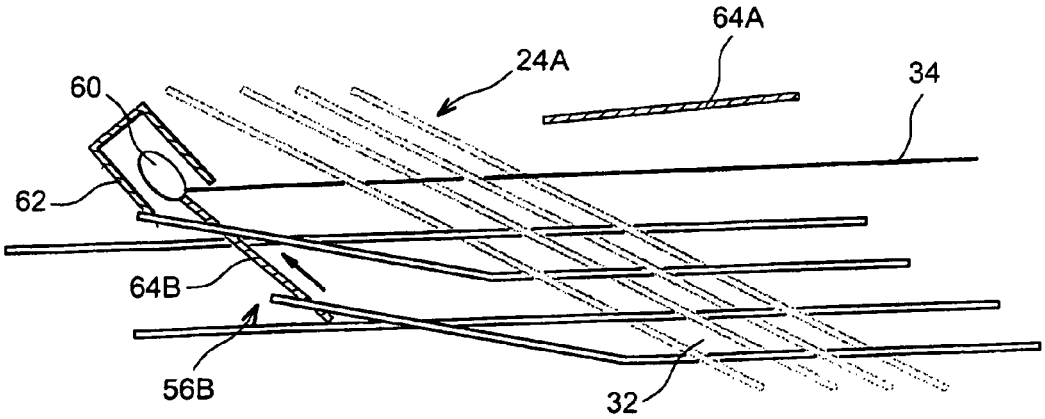

5. The second rapier 64B is inserted into the second weaving shed 52B to go and fetch the spool 60 that is fixed there (FIG. 5D).

Figure 5E:
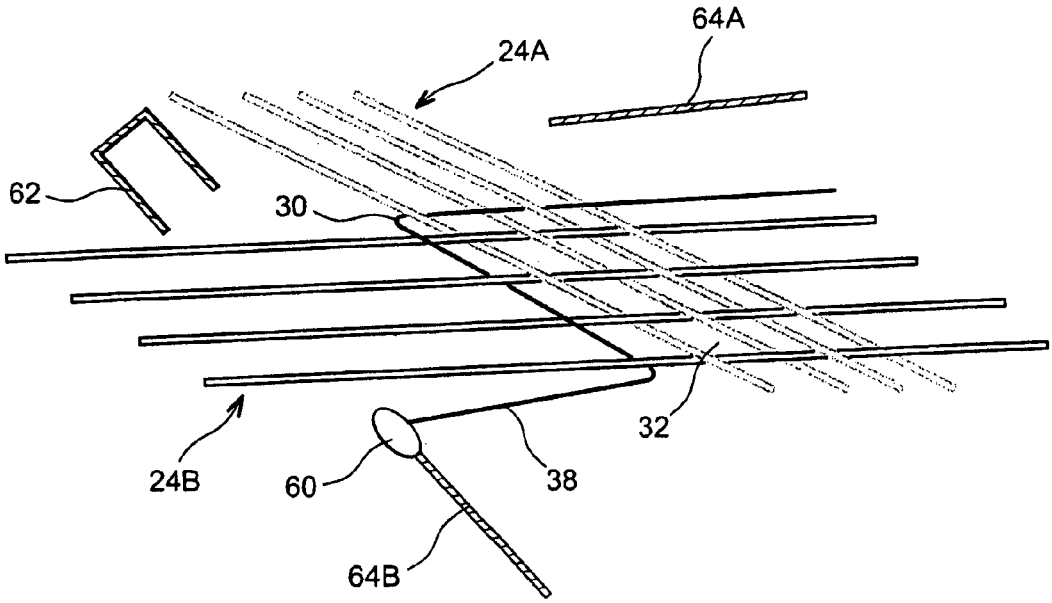

6. The sheath 62 releases the spool 60 and the rapier 64B remerges from the weaving shed 56B with the spool 60. The weaving shed 56B can then close and the strip 24B reforms. Then comes tamping of the pick 34 inserted on each side of the woven face 32, with the formation of an angle 30 (FIG. 5E).

Figure 5F:
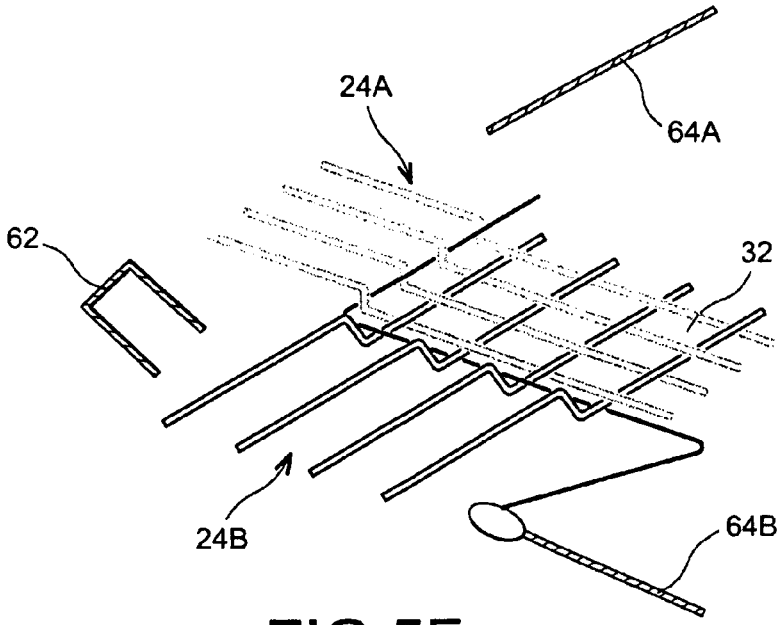
Figure 5G:
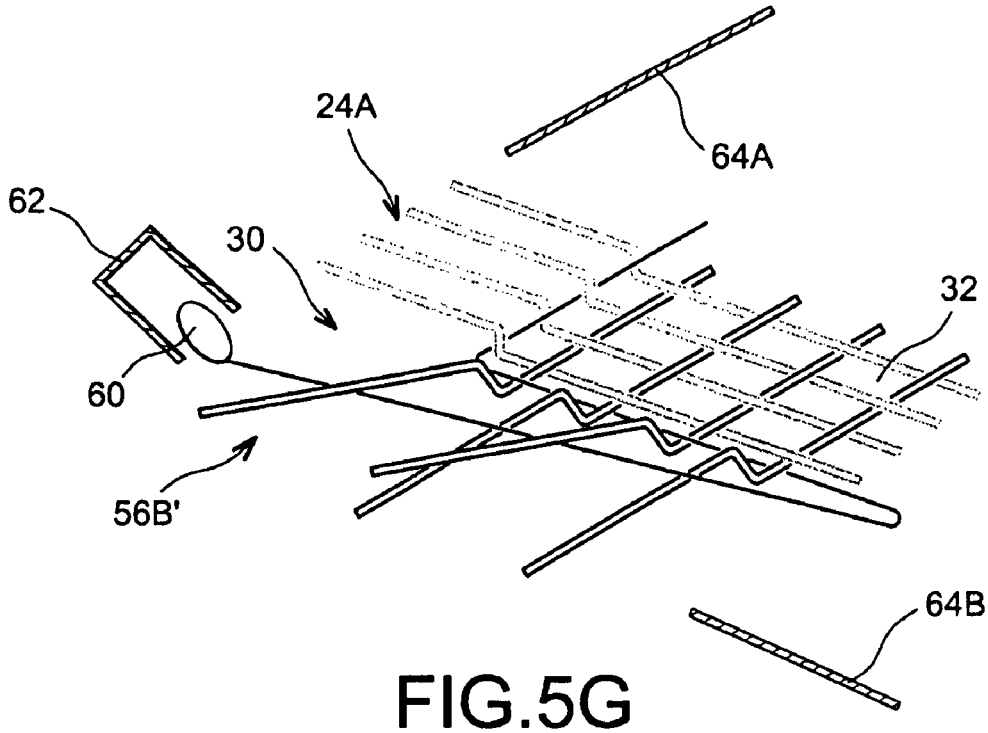

7. For the creation of a three-dimensional corner, there is a thrust by the mobile frame 66 in order to offset the first face 32 vertically (FIG. 5F).

8. The procedure is then repeated, with opening of a weaving shed 56B' in the second strip 24B, insertion of the second rapier 64B to deposit the spool 60 in the sheath, and withdrawal of this rapier so that the sheath 62 is turned toward the first rapier 64A (FIG. 5G); and so on.

The secondary weft threads 34 are thus inserted in a non-rectilinear manner, along direction X and then along Y, allowing creation of the orthogonal faces; the reserves of threads X and Y combined with the collective tension regulation systems are used to supply the material for the composition of these faces.

It is preferable that the tamping comb of each secondary pick 34 should be unitary for the different faces, so as to proceed when all of angle 30 has been completed. Thus, the parallel orientation of the weft threads 34 in relation to the first face 32 is optimised.

Figure 5H:
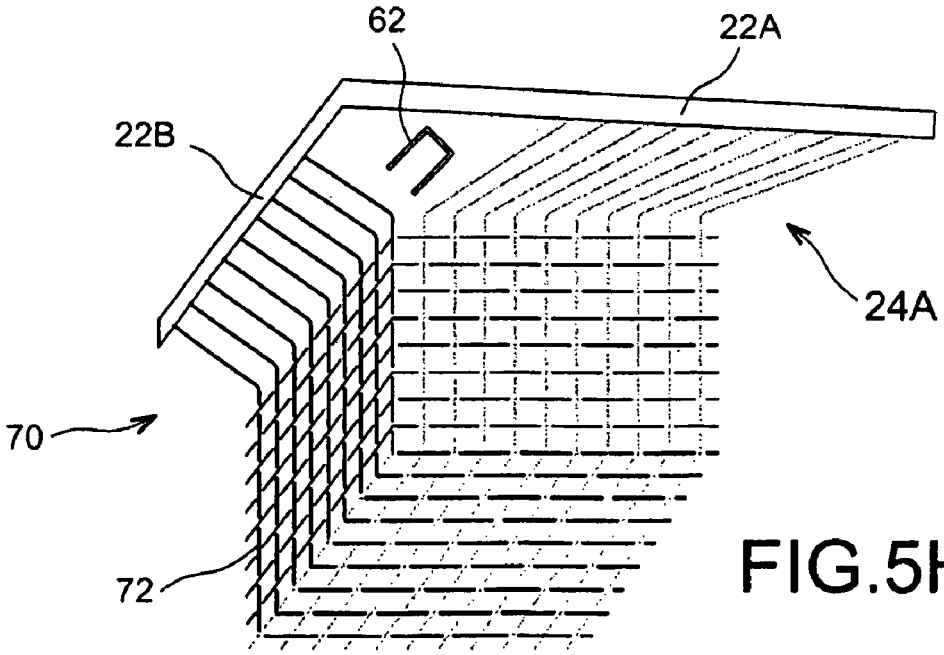

We thus obtain a corner 70, illustrated in FIG. 5H, whose thread 72 can be continuous, by virtue of a non-rectilinear insertion and a drawing-in in open frames 22A, 22B during the weaving phase. This is particularly advantageous since the existing three-dimensional machines create only "volumic" shapes (cubic, cylindrical, etc.) or profiled (T, H, E, . . . ). Here, it concerns the manufacture of three-dimensional shapes 70 with two-dimensional walls. Moreover, this system meets the requirement in terms of continuity of thread 72. In addition, the movement along the Z axis allows one to mould to the shapes of the three-dimensional fold 10, thus greatly facilitating its creation, with this occurring during its weaving phase.

Figure 1:
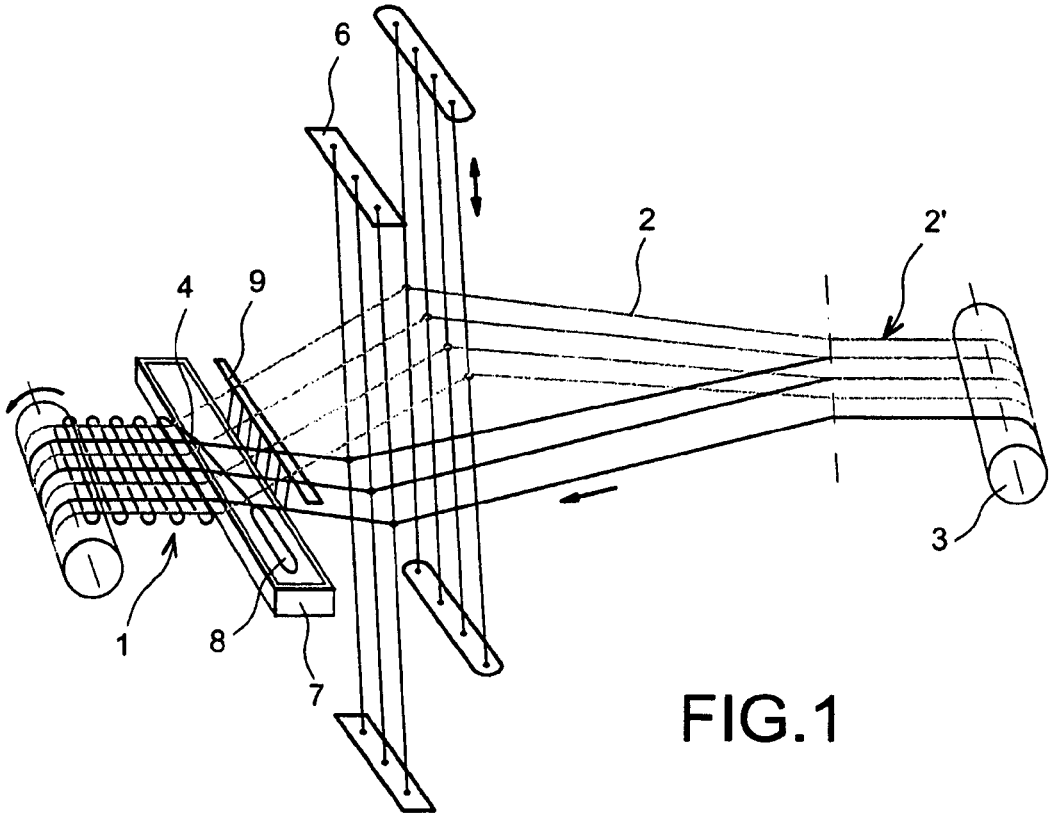
Figure 2:
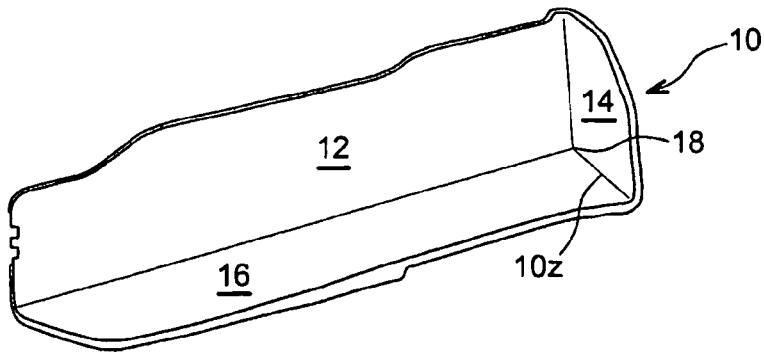

In particular, the device is designed for the creation of box corners according to FIG. 2, in which the dimensions of the piece 10 are of the order of 400 mm×220 mm×200 mm, or even 800×220×200 $mm^3$. The carbon thread used advantageously includes between 6,000 and 24,000 filaments, and preferably 12,000. The ideal mass per unit area of each fold is 200 g/m$^2$ to 1200 g/m$^2$, and preferably 600 g/m$^2$. A trihedral angle 70 thus created allows the formation of a box corner 10 after impregnation with a resin. The volumic ratio of the fibres within the total volume of the finished piece is advantageously 55 to 60%. The preform can preferably be superposed upon other preforms of the same nature, advantageously with an angulation between their threads, so as to optimise the strength of the final piece 10 in relation to the directions of the mechanical stresses in the composite part.

Although described with a triple-rectangle trihedral corner 70, other options can be envisaged. In particular, it is possible to offset the first face 32 obliquely so as to form faces that are not orthogonal to each other. It is also possible not to effect a right-angle weave on the first face 32.

Again, it is possible to create a structure with several corners, based in particular on a hexahedron, and including four or five faces. In this case, the aforementioned stages 5 and 6 are repeated as many times as there are angles 30 (and therefore sheaths 62) until the spool reached the last rapier or until it has done a complete sequence, where stage 7 is then engaged. If a complete sequence (four picks passed about the face 32) has been completed, it is possible either to retrieve the spool 60 with the first rapier 64A, so that the shuttle 60 continues to turn, passing from one rapier to the next, or like a "conventional" arrival at the last rapier, to trigger a reverse passage to the spool, so that the spool is transmitted from sheath to sheath by the rapiers until it reaches its initial position.

The loom of the invention is therefore particularly suitable for the weaving of reinforcements for composite structures, with a view to including optimisation that allows smaller size while also allowing the weaving of threads to form angles or corners, in three dimensions where appropriate. However, other applications can equally well be envisaged, and in particular, each of the elements making up the loom of the invention can be used independently of each other.

The invention claimed is:

1. A weaving loom used for weaving a fabric in weft of which at least one thread forms a angle, with the loom structure forming a frame with four sides that comprises:

first means for drawing-in threads on a first side to form a first strip between the first side and a third side;

second means for drawing-in threads on a second side to form a second strip between the second side and a fourth side, including open hooks around which the threads can form a loop;

a first weaving-shed formation system on the first strip at a level of the first side;

a second weaving-shed formation system on the second strip at a level of the second side, including open elements for manipulating the threads;

a spool configured to contain a winding of weft thread intended to weave the strips;

a receptacle located between the first and second sides, and the first and second strips, used to hold the spool; and a first and a second pick-tamping comb traversing the first and second strips.

2. A loom according to claim 1, in which elements for manipulating the threads of the second weaving-shed formation system include drawing-in hooks extended by operating rods, with each rod pivoting about an axle.

3. A loom according to claim 2, in which the second weaving-shed formation system includes means for putting selective pressure on the rods, switching between a rest position and an operating position so that, in the operating position, certain drawing-in hooks are offset in relation to the others, perpendicularly to the strip.

4. A loom according to claim 3, in which the means for putting selective pressure tilts about the same axle as the operating rods and includes an initialization axle configured to exert a thrust on all the rods to align the rods, and selection means configured to exert an opposite pressure on certain rods to form the weaving shed.

5. A loom according to one of claim 1, in which the first drawing-in system includes open hooks around which the threads can form a loop.

6. A loom according to claim 5, in which the first weaving-shed formation system is of a similar nature to the second weaving-shed formation system.

7. A loom according to one of claim 1, in which the drawing-in hooks are associated with tensioning means.

8. A loom according to one of claim 1, further comprising first and second means to move the spool across the first and second strips along first and second directions, and to place the spool into the sheath.

9. A loom according to claim 8, in which the sheath includes an opening for reception of the spool, and rotates between two positions in which the opening is directed along the first and the second directions respectively.

10. A loom according to claim 9, in which the spool includes an appendage of pointed shape, and the sheath includes, on its face opposite to the reception opening, an orifice complementary to the appendage so as to guide the spool during its insertion.

11. A loom according to claim 8, in which the means to move the spool includes first and second rapiers that can be attached to the spool in a removable manner, and the sheath includes means to hold the spool, in a removable manner.

12. A loom according to one of claim 1, further comprising means for moving a woven part of the first strip in a direction orthogonal to the strips.

13. A loom according to one of claim 1, in which the first and second combs are attached to each other.

14. A loom according to one of claim 1, further comprising third drawing-in hooks on the side opposite to the second side, to form the fourth side.

15. A loom according to one of claim 1, further comprising a second sheath opposite to the first, in relation to one of the first and second strips, and a third rapier for insertion of the spool and pointing toward the second sheath.

* * * * *